US005749073A

United States Patent [19]

Slaney

[11] Patent Number: 5,749,073

[45] Date of Patent: May 5, 1998

[54] SYSTEM FOR AUTOMATICALLY MORPHING AUDIO INFORMATION

[75] Inventor: Malcolm Slaney, Los Altos Hills, Calif.

[73] Assignee: Interval Research Corporation, Palo Alto, Calif.

[21] Appl. No.: 616,290

[22] Filed: Mar. 15, 1996

[51] Int. Cl.[6] ..... G10L 3/02

[52] U.S. Cl. ..... 704/278; 704/203; 704/206; 704/209; 704/241; 704/265; 704/270

[58] Field of Search ..... 395/2.12, 2.15, 395/2.18, 2.74, 2.77–2.79, 2.5, 2.87

[56] References Cited

U.S. PATENT DOCUMENTS

| | | | |
|---|---|---|---|
| 4,706,537 | 11/1987 | Oguri | 84/746 |
| 5,097,326 | 3/1992 | Meijer . | |
| 5,291,557 | 3/1994 | Davis et al. . | |
| 5,327,521 | 7/1994 | Savic et al. | 704/272 |
| 5,371,315 | 12/1994 | Hanzawa et al. | 84/603 |
| 5,473,759 | 12/1995 | Slaney et al. . | |
| 5,583,961 | 12/1996 | Pawlewski et al. | 395/2.5 |
| 5,625,749 | 4/1997 | Goldenthal et al. | 395/2.63 |

OTHER PUBLICATIONS

Davis, Stephen B., et al, "*Comparison of parametric Representations for Monosyllabic Word Recognition in Continuously Spoken Sentences*", IEEE Transactions of Acoustics, Speech, and Signal Processing, vol. ASSP–28, No. 4, 4, Aug. 1980.

Van Immerseel, Luc M., et al, "Pitch and voiced/unvoiced determination with an auditory model", J. Acoust. Soc. Am. 91 (6), Jun. 1992, 1992 Acoustical Society of America, pp. 3511–3526.

White, George M., et al, "Speech Recognition Experiments with Linear Prediction, Bandpass Filtering, and Dynamic Programming", IEEE Transactions on Acoustics, Speech, and Signal Processing, vol. ASSP–24, No. 2, Apr. 1976, pp. 183–188.

Yong, Mei, "A New LPC Interpolation Technique for CELP Coders", IEEE Transactions on Communications, vol. 42, No. 1, Jan. 1994, pp. 34–38.

"Morpheus Z–Plan Synthesizer", E–mu Systems, Inc.

Oberheim Digital Presents a Technology Dossier On Fourier analysis Resynthesis, 1994, pp. 1–16.

World Wide Web Home Page for Voxware, Inc., describing the Morph–Kit voice utility.

Announcement for Sound Morph program for Macintosh.

Amini, Amir A., et al, "Using Dynamic Programming for Solving Variational Problems in Vision", IEEE Transactions on Pattern Analysis and Machine Intelligence, vol. 12, No. 9, Sep. 1990, pp. 855–867.

(List continued on next page.)

*Primary Examiner*—Allen R. MacDonald
*Assistant Examiner*—Alphonso A. Collins
*Attorney, Agent, or Firm*—Burns, Doane, Swecker & Mathis, L.L.P.

[57] ABSTRACT

In the first step of a sound morphing process, each sound which forms the basis for the morph is converted into one or more quantitative representations, such as spectrograms. After the representations have been obtained, the temporal axes of the two sounds are matched, so that similar components of the two sounds, such as onsets, harmonic regions and inharmonic regions, are aligned with one another. Other characteristics of the sounds, such as pitch, formant frequencies, or the like, are then matched. Once the energy in each of the sounds has been accounted for and matched to that of the other sound, the two sounds are cross-faded, to produce a representation of a new sound. This representation is then inverted, to generate the morphed sound.

47 Claims, 3 Drawing Sheets

OTHER PUBLICATIONS

Beier, Thaddeus, et al, "Feature–Based Image Metamorphosis", SIGGRAPH '92, Chicago, Jul. 26–31, 1992, p. 35–42
Blinn, James F., "What's the Deal with DCT?", IEEE Computer Graphics & Applications, Jul. 1993, pp. 78–83.
Bruderlin, Armin, et al, "Motion Signal Processing", Computer Graphics & Proceedings, Annual Conference Series, 1995, pp. 97–104.
Covell, Michele, et al, "Spanning the Gap Between Motion Estimation and Morphing", Interval Research Corporation, 1994, pp. V–213–V–216.
Deller et al, "Dynamic Time Wraping", Discrete–time Processing of Speech Signals, New York, Macmillan Pub. Co., 1993, pp. 623–676.
Depalle, Philippe, et al, "Tracking of Partials for Additive Sound Synthesis Using Hidden Markov Models", IRCAM, pp. I–225–I–228.
Griffin, Daniel W., et al, "Signal Estimation from Modified Short–Time Fourier Transform", IEEE Transactions on Acoustics, Speech, and Signal Processing, vol. ASSP–32, No. 2,Apr. 1984, pp. 236–243.

Hunt, M, J., et al, "Experiments in Syllable–Based Recognition of Continuous Speech", Bell–Northern Research, Apr. 1980, pp. 880–883.

Savic, Michael et al, "Voice Personality Transformation", Digital Signal Processing 1, 107–110 (1991).

Secrest, Bruce, et al, "An Integrated Pitch Tracking Algorithm for Speech Systems", Texax Instruments, Inc., ICASSP 83, Boston, pp. 1352–1355.

Tellman, Edwin, et al, "Timbre Morphing of Sounds with Unequal Numbers of Features", CERL Sound Group, University of Illinois, rev. May 1, 1995, pp. 1–12.

Valbret, H., et al, "Voice transformation using PSOLA tehnique", Speech Communication, vol. 11, Nos. 2–3, Jun. 1992, pp. 175–187

SYSTEM FOR AUTOMATICALLY MORPHING AUDIO INFORMATION

FIELD OF THE INVENTION

The present invention is directed to the manipulation of sounds and other one-dimensional signals, and more particularly to the morphing of two audio signals to generate a new sound having characteristics between those of the original sounds.

BACKGROUND OF THE INVENTION

The manipulation of a sound, to produce a different sound, has applicability to a number of different fields. For example, in musical applications the transformation of one audio signal into another audio signal can be used to produce new sounds with synthesizers and the like. In the movie industry, the transformation of one sound into another sound, such as changing a speaker's voice to sound like the voice of a different person, can be used to create special effects. In a similar fashion, a person's voice can be manipulated so that it is disguised, for security purposes.

Different types of sound manipulation are employed for these various purposes. A first type of sound modification involves the mixing of two or more sounds. This type of modification might be employed in a musical environment, for example, to provide equalization or reverberation. These effects are achieved by passing the sounds through simple filters whose operation is independent of the actual data being filtered.

A second type of sound modification is based upon data-dependent filtering. For example, the pitch of a sound can be increased or decreased by a predetermined percentage to disguise a person's voice.

A third type of manipulation, which is more heavily data-dependent, is known as voice transformation. In this type of manipulation, an acoustic feature of speech, such as its spectral profile or average pitch, is analyzed to represent it as a sequence of numbers, and then modified from the original speaker's voice, typically in accordance with the statistical properties of a target voice. For example, histogram mapping might be employed to transform the speaker's pitch to that of the target voice. Each time a particular sound is spoken, its formant frequencies are changed so they are similar to those of the target speaker. When the sound is resynthesized with the new acoustical parameters, the target voice results. Further information relating to this type of sound manipulation is described in U.S. Pat. No. 5,327,521, as well as in Savic et al, "Voice Personality Transformation", *Digital Signal Processing* 1, Academic Press, Inc., 1991, pp. 107–110; and Valbret et al, "Voice Transformation Using PSOLA Technique", *Speech Communication* 11, Elsevier Science Publishers, 1992, pp. 175–187.

A fourth type of audio manipulation, and the one to which the present invention is directed, is known as audio morphing. Audio morphing differs from sound filtering, from the standpoint that two or more sounds are used as inputs to create a single sound having characteristics of each of the original sounds. Audio morphing also differs from voice transformation by virtue of the fact that the resulting sound is a smooth warp and blend of two or more original sounds. The morphed sounds share some of the properties of the original sounds.

Generally speaking, morphing is the process of changing one physical sensation smoothly into another. Its most prevalent use today is in the visual domain. In this context, the two images are warped, and then cross fades are implemented so that one image blends smoothly into the other. Typically, the beginning and ending images are static, i.e., they do not change with time as the morphing process is carried out.

Audio morphing involves the process of generating sounds that lie between two source sounds. For example, in a series of steps the sound of a human scream might morph into the sound of a siren. Unlike images, sounds are not static. The amplitude of a sound at any given time, by itself, does not present meaningful information. Rather, it must be considered over a period of time. Thus, audio morphing is more complex, because it must take into consideration the time course of a sound during the morphed sequence.

In the past, audio morphing has been carried out by using a sinusoidal analysis of the sounds used to create the morph. See, for example, Tellman et al, "Timbre Morphing of Sounds with Unequal Numbers of Features", *Jour. of Audio Eng. Soc.*, Vol. 43, No. 9, September 1995. In sinusoidal analysis, a sound is broken down into a number of discrete sinusoids. A morph is generated by changing the amplitude and frequency of the sinusoids. This technique only has applicability to harmonic sounds, such as those from musical instruments. It cannot be used to morph other types of sounds, such as noise or speech that includes fricatives, i.e. inharmonic sounds, as exemplified by the consonant "c" in the word "corner."

Another limitation associated with morphing based upon sinusoidal analysis is that it does not readily lend itself to automation to correctly label individual sinusoids in the two original sounds and match them to one another. Often, there is a significant amount of manual tuning that is required, to identify the discrete sinusoids that result in the best sound.

An important requirement, and the source of difficulty in any type of morph, is preserving the perception of objects. Except for fortuitous circumstances, simply cross-fading two pictures of faces will give an image that looks like two faces. The perception that one is looking at a single object is lost because features (such as ear lobes) are duplicated. Likewise in audio, a morph should preserve the perception that the result has the same number of auditory objects as the original. Many of the properties that cause sounds to be perceived as one object are described in Bregman, "Auditory Scene Analysis", MIT Press. An audio morph should preserve these properties.

It is desirable, therefore, to provide a technique for morphing any given sound into any other sound, which is not limited to specific types of sounds, such as harmonic sounds. It is further desirable to provide such a technique which readily lends itself to automation, and thereby reduces the manual effort required to produce a morphed sound.

BRIEF STATEMENT OF THE INVENTION

In accordance with the present invention, these objectives are achieved by a sound morphing process that is based on the fact that the different dimensions of sounds can be separated and individually operated upon. A sound morphing process in accordance with the present invention is comprised of a series of basic steps. As a first step, each sound which forms the basis for the morph is converted into multiple representations that encode different features of the sound and quantitatively depict one or more salient features of the sounds. In a preferred embodiment of the invention, the multiple representations are independent of one another. After the representations have been obtained, the temporal axes of the two sounds are matched, so that similar components of the two sounds, such as onsets, harmonic regions and inharmonic regions, are aligned with one another. After the temporal matching, other relevant characteristics of the sounds, such as pitch, are also matched for each corresponding instant of time in the two sounds. Once the energy in each of the sounds has been accounted for and matched to that of the other sound, the two sounds can be warped and cross-faded, to produce a representation of the morphed sound, such as a new spectrogram. The interpolated representation is then inverted, to generate the morphed sound.

By using a spectrogram or other dense representation of a sound, the morphing process is not limited to harmonic sounds. Rather, any sound which is capable of being represented can form the basis for an audio morph. The particular representations that are chosen will be dependent upon the characteristics of the sound that are important. The primary criteria is that the representation be perceptually relevant, i.e. it relates to some dimension of the sound which is detectable to the human ear, and allows the sound to be smoothly interpolated along that dimension. Using such representations, any two or more sounds can be matched to one another to produce a morph.

Another advantage of the morphing process of the present invention is that it can be easily automated. For example, the temporal warping of two representations of a sound, to match them to one another, can be computed using known techniques, such as dynamic time warping that produces the lowest mean-squared-difference. Similarly, other components of the sound can be automatically matched with one another, for example, by applying dynamic time warping between two spectral frames.

Further features of the invention, and the advantages provided thereby, are explained in greater detail hereinafter with reference to exemplary embodiments illustrated in the accompanying drawings.

DETAILED DESCRIPTION

Generally speaking, morphing is the process of generating a range of sensations that move smoothly from one arbitrary entity to another. For example, a video morph consists of a series of images which successively show one object smoothly changing its shape and texture until it becomes another object. The same objectives are desirable for an audio morph. A sound that is perceived as coming from one object should smoothly change into another sound, maintaining the shared properties of the starting and ending sounds while smoothly changing other properties.

In the following discussion of the invention, it is described with reference to its implementation in the morphing of two or more sounds. It will be appreciated, however, that the principles of the invention are not limited to sound signals. Rather, they are applicable to any type of one-dimensional waveform.

In the context of the present invention, two different types of audio morphing can be produced. One type of morph is temporally based. In this situation, a sound is considered as a point in a multi-dimensional space. The dimensions of this space can include the spectral shape, pitch, rhythm and other perceptually relevant auditory dimensions. A morph is obtained by defining a path between two sounds represented at two points in the space. This type of morph is analogous to image morphing. For example, a steady state clarinet tone might morph into the sound of an oboe or into a singer's voice.

In the second type of morph, a sequence of individual sounds are generated which smoothly change from one to another. For example, the spoken word "corner" can change into the word "morning" in a sequence of small steps. Each individual step represents a small difference from the previous word, and in the middle of the sequence the word sounds like a cross between "corner" and "morning." This type of morph is referred to as a cyclostationary morph. It is cyclic because a sound is played repetitively to transition from one word to the other. It is also stationary since each sound instance is a static example of one of the in-between sounds in the sequence.

Different variations of this second type of morph are possible. For example, rather than generating a sequence of sounds that transition from one word to another, the desired output may be just one of the intermediate sounds. Alternatively, a sound can be produced that is a mixture of different components of the original sounds. For example, the output sound might utilize the pitch from one word, the timing from a second word, and the spectral resonances from a third word.

Figure 1:
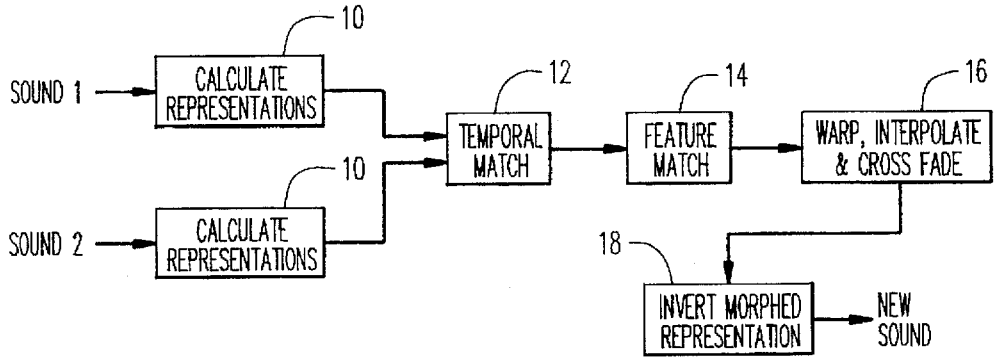
FIG. 1 is a block diagram illustrating the overall process for morphing two sounds in accordance with the present invention.

The morphing of one sound into another, in accordance with one embodiment of the present invention, is schematically illustrated in the block diagram of FIG. 1. A brief description of the overall process is first presented, and followed by a more detailed discussion of individual aspects of the process. This particular embodiment relates to the morphing of speech. It will be appreciated, however, that this example is for illustrative purposes. The principles which underlie the invention are equally applicable to music and other types of sound as well.

Referring to FIG. 1, two input sounds provide the basis from which the morphed sound is produced. In practice, more than two sounds can be used to provide the original input data. For purposes of the present explanation, a two-sound example will be described. As a first step, various representations 10 of each sound are generated. For example, the representations might be two or more different kinds of spectrograms for each sound. Corresponding representations of the two sounds are then temporally matched, such as by means of a dynamic time warping process 12. In this step, similar components of each sound, such as the onset or attack portion, harmonic and inharmonic regions, and a decay region, are temporally aligned with one another. After the temporal alignment, other relevant features of the two sounds undergo a matching process 14. For example, if the sounds contain harmonic components, the pitches of the two sounds can be matched. The matching of the two sounds results in a dense mapping of corresponding elements of the sounds to one another, for each of the dimensions of interest.

After all of the relevant energy components in the two sound signals have been matched, the sounds undergo warping, interpolation and cross fading 16. For example, if a morph from Sound 1 to Sound 2 is to take place in five steps, the first interpolation of the sound in the sequence comprises 100% of Sound 1 and 0% of Sound 2. The second interpolated sound of the sequence is comprised of 75% of Sound 1's components and 25% of Sound 2's components. Successive interpolation steps comprise greater proportions of Sound 2, until the final step is comprised entirely of Sound 2. For each step in the sequence, the interpolation determines the appropriate percentage of each of the two components to combine with one another. These combined components form a new representation of the morphed sound, e.g., a new spectrogram. This representation can then be inverted, at 18, to generate the actual morphed sound for that step in the sequence. By successively reproducing each of the sounds in the sequence, a smooth transition from Sound 1 to Sound 2 can be heard.

The calculation of the representation 10 transforms the sound from a simple waveform into a multi-dimensional representation that can be warped, or modified, to produce a desired result. To be useful, the representation of the sound must be one that is invertible, i.e. after one or more of its parameters are modified, the result can be used to generate an audible sound. The particular representation that is employed should preserve all relevant dimensions of the sound. For example, in harmonic sounds pitch is an important characteristic. Thus, for the morphing of harmonic sounds, a representation which preserves the pitch information should be employed. Examples of suitable representations for harmonic sound include spectrograms, such as the short-term Fourier transform, as well as cochleagrams and correlograms.

Inharmonic sounds, such as noise and spoken fricatives, do not have a pitch component. Similarly, if a spoken word is whispered, its pitch is not significant. Consequently, other types of representation may be more appropriate for these types of sounds. For example, linear predictive coding (LPC) coefficients might be used to represent the broad spectral characteristics of an inharmonic sound.

Sinusoidal analysis is often accomplished by analysing a sound with a wide-band spectrogram. Individual sinusoids are displayed as peaks or lines in the spectrogram. A sinusoidal analysis of the sound uses the locations of the individual peaks or lines in the spectrum to model the entire sound. This approach uses a sparse representation of the sound since some sort of threshold is empoyed to pick the discrete sinusoids that are used. This enforces a model on the signal, whether it fits or not. In contrast, a spectrogram preserves the level of all components of the sound, the representation is dense and continuous as a function of frequency. In a dense representation, the entire spectrum is preserved, not just the peaks.

Preferably, a multi-dimensional dense representation of sounds is employed, where each dimension is independent and salient to the perceived result. In the case of speech, two relevant dimensions of a sound are its pitch and its broad spectral shape, i.e. its formant frequencies. These two dimensions roughly correspond to the rate at which the human glottis produces air pulses during speech (pitch) and the filtering of these pulses that is carried out by the mouth and nasal passages (formants). As discussed previously, another relevant dimension of sounds is their timing.

Figure 2:
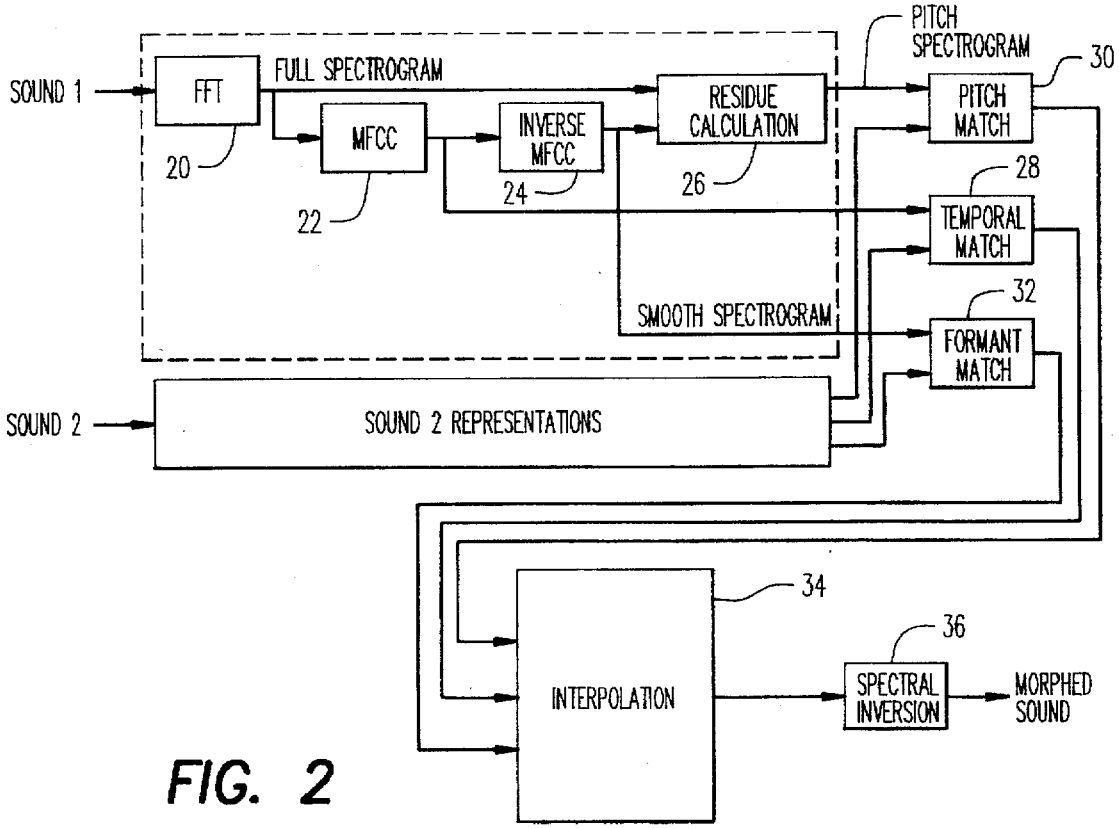
FIG. 2 is a more detailed block diagram of an embodiment of the invention for morphing speech.

FIG. 2 illustrates one embodiment of the invention in which each of these three dimensions can be separately represented to generate a morph. At the outset, a conventional narrow-band spectrogram of a sound is obtained by processing it through a Fast Fourier Transform 20. The Fast Fourier Transform provides a quantitative analysis of the sound in terms of its frequency content. The spectrogram of the sound is then further analyzed to determine its mel-frequency cepstral coefficients (MFCC) 22. For a description of the procedure for calculating an MFCC representation, see Hunt et al., "Experiments in Syllable-based Recognition of Continuous Speech", *Proceedings of the* 1980 *ICASSP*, Denver, Colo., pp. 880–883, the disclosure of which is incorporated herein by reference. Briefly, the MFCC for a sound is computed by resampling the magnitude spectrum to match critical bands that are related to auditory perception. This is carried out by combining channels of the spectrogram to produce a filter bank which approximates the auditory characteristics of the human ear. The filter bank produces a number of output signals, e.g. forty signals, which are compressed using a logarithm and undergo a discrete cosine transform to rearrange the data values. A predetermined number of the lowest frequency components, e.g. the thirteen lowest filter coefficients, are then selected. These coefficients define a space where the Euclidean distance between vectors provides a good measure of how close two sounds are. Hence, they can be used to find a temporal match between two sounds, as described in detail hereinafter.

Since the MFCC is a low dimensional representation of the sound, it can be used to compute its broad spectral shape. To this end, the MFCC is inverted at 24 by applying the inverse of the cosine transform, to provide a smooth estimate of the filter bank output that was used to compute the MFCC. After undoing the logarithm, this smooth estimate is then reinterpolated, for example by means of an inverse Bark scale, to yield a new spectrogram. This spectrogram corresponds to the original spectrogram, without the high spatial-frequency variations due to pitch. In the context of the present invention, this spectrogram is referred to as a "smooth spectrogram", and provides a representation of the frequency formats in the original sound.

Other types of processing, such as homomorphic filtering or LPC, can be used to calculate a smooth spectrogram. However, MFCC processing is preferred for many speech recognizers and is easier to apply to different sounds such as music.

Furthermore, the smooth spectrogram can be used to obtain a representation of the pitch information in a sound. More particularly, a conventional spectrogram encodes all of the information in a sound signal, and the smooth spectrogram describes the sound's overall spectral shape. The conventional spectrogram is divided by the smooth spectrogram at 26, to produce a residual spectrogram that contains the pitch and voicing information in a sound. In the context of the present invention, the residual spectrogram is referred to as a "pitch spectrogram."

In the embodiment of FIG. 2, three representations are derived for each sound, namely the MFCC transform which is used for temporal matching, the smooth spectrogram which provides format information, and the pitch spectrogram which provides pitch and voicing information. In the illustration of FIG. 2, the individual steps for obtaining these representations are shown with respect to one sound. It will be appreciated that similar processing is carried out to provide representation for a second sound, which forms another component of the audio morph. The corresponding representations of the two sounds are then matched to one another at 28–32.

Figure 3:
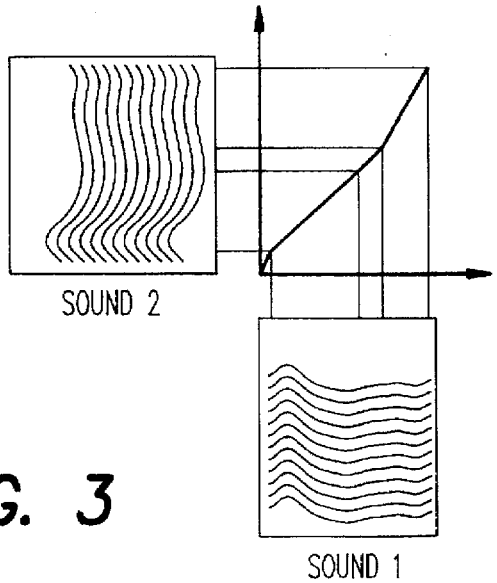
FIG. 3 is an illustration of the audio correspondence between two sounds.

Temporal matching of sounds at 28 (FIG. 2) is desirable since, over the course of a morph, features which are common to both sounds should be matched and remain relatively fixed in time. Referring to FIG. 3, an example of the temporal correspondence between two sounds is illustrated. In the figure, a spectrogram for one sound, e.g. a beginning sound, is shown at the bottom of the figure, and the spectrogram for a ending sound is shown above and to the left of the spectrogram for the beginning sound. In the spectrogram for the beginning sound, time is represented along the horizontal axis, and frequency is depicted on the vertical axis. To illustrate the temporal matching of the two sounds, the spectrogram for the ending sound is rotated counter-clockwise 90° relative to the spectrogram for the beginning sound.

In the preferred embodiment of the invention, dynamic time warping is employed to find the best temporal match between two sounds, using the distance metric provided by the MFCC transforms of the sounds. For detailed information regarding dynamic time warping, reference is made to Deller et al, "Dynamic Time Warping", *Discrete-time Processing of Speech Signals,* New York, Macmillan Pub. Co., 1993, pp. 623–676, the disclosure of which is incorporated herein by reference. The result of the dynamic time warping process is to provide control points in time which identify the frames of one sound that line up with those of the other sound. The correspondence of the frames provides an indication of the amount by which each segment of a sound must be temporally compressed or expanded to match it to the corresponding features in the other sound.

Once the two sounds have been aligned temporally at 28, they can be matched at each corresponding time instant. For each pair of corresponding frames, the relevant acoustical features that are indicated by the representations of the two sounds need to be matched. For example, in the pitch spectrogram, the pitch information in the sound is visible as a series of peaks. The spacing of the peaks is proportional to the pitch. The matching of the pitch data for two sounds at 30 essentially involves expanding or compressing the pitch spectrograms to align the harmonic peaks. For any given instant in time, the pitch of one sound can be represented as p1, and the pitch of the other sound at the corresponding time is p2. For the best match, the frequency axis of the second sound's pitch spectrogram must be compressed by p1/p2. If p1 is larger than p2, the frequency axis of the pitch spectrogram for the second sound is actually stretched. When this process is carried out, the result is a dense match linking a frequency $f_1$ in the first pitch spectrogram and a corresponding frequency $f_2=p_2/p_1*f_1$ in the second pitch spectrogram.

Some sounds contain both harmonic and inharmonic components. For example, a spoken word may include both voiced and unvoiced sounds. An example of an unvoiced sound is the consonant "c" in the word "corner". The unvoiced components of the word do not contain pitch information. However, the voiced, or harmonic, components have a pitch, which should be matched to the pitch of another sound to form the morph. Another difficulty arises when parts of a sound are only partially voiced. To ensure that the pitch of the morphed sound is consistent and smoothly changing, an assumption is made during the matching process that a pitch exists throughout the duration of each of the sounds which forms the basis for the morph. Using this assumption, a smoothly varying curve is estimated for pitch throughout the entire sound, including the inharmonic regions where it is normally absent. In a preferred implementation of the invention, a dynamic programming technique can be used to calculate a smooth pitch function for the duration of a sound. An example of a suitable dynamic pitch programming technique is disclosed, for example, in Secrest et al, "An Integrated Pitch Tracking Algorithm for Speech Systems", *Proceedings of* 1983 *ICASSP,* Boston, Mass., vol. 3, pp. 1352–1355, 1983. In particular, one implementation combines a clipped autocorrelation, as described in Rabiner and Schafer, *Digital Processing of Speech Signals,* Prentice Hall, 1978, p. 154, with the energy minimization technique described in Amini et al, "Using Dynamic Programming for Solving Variational Problems in Vision," *IEEE Transactions on Pattern Analysis and Machine Intelligence,* Vol. 12, No. 9, September 1990, pp. 855–867. The pitch functions that are calculated for respective sounds with such a technique can then be matched to one another, as described previously.

Once all of the relevant energy in each sound has been accounted for and matched, the corresponding portions of the two sounds can be warped and cross-faded to produce a representation for a new sound. Warping in both the time and frequency dimensions lines up corresponding features in the two sounds. A morph includes some type of interpolation or cross-fading step. Scalar dimensions are easiest to morph. If one component of a sound description is loudness, then the loudness of the morph should change smoothly from the loudness of the first sound to the loudness of the second. The same holds true for a scalar quantity like pitch. However, acoustic information is not always scalar. Interpolations of temporal information, smooth spectrograms, and pitch spectrograms present a more complex problem, because they are based upon a dense match between pairs of one-dimensional curves.

Audio morphing is simpler than image morphing because each dimension can be considered independently. An important step in audio morphing is to warp and interpolate two one-dimensional signals. The one-dimensional signals might be cepstral coefficients over time as used to match the temporal aspects of a sound, or spectral amplitudes over frequency when morphing spectrogram slices. In each case, one-dimensional morphing involves a determination of a dense set of matches. For each point in the output signal, the best two points in the original waveforms are determined. These points are then warped and interpolated to give the value of the morphed signal. The process is the same whether the signal is scalar or a vector value.

Figure 4:
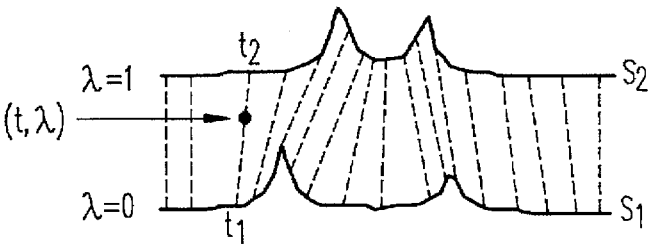
FIG. 4 is a diagram of the procedure to warp and interpolate two signals.

With reference to FIG. 4, the data to be morphed is described as s1(t) and s2(t). These two curves might represent slices of smooth spectrograms, for example. The objective of the morph is to find a new curve s(lambda,t) such that the s function is a fraction, lambda, between the s1 and s2 curves. Since the matches between curves are monotonic, matching lines do not cross such that, for each point (lambda,t), there is only one line establishing correspondence. The interpolation problem simplifies to finding the times t1 and t2 that should be interpolated to generate the data at (lambda,t).

Given lines ending at t1 and t2, the intersection with a line at some fractional distance lambda between the two curves is at $$\frac{t-t1}{t2-t1} = \text{lambda} \rightarrow t = \text{lambda} * (t2-t1) + t1$$

Given the proper values for t1 and t2, the new data at (lambda,t) is generated by cross-fading the warped signals.

$$s(\text{lambda},t)=(1-\text{lambda}) * s1(t1)+\text{lambda} * s2(t2)$$

When lambda is zero, the result will be identical to s1. When lambda is 1, the result is s2. In between, the morphing process smoothly cross-fades between the two functions.

The mappings between s1 and s2 are described as paths. Path1 warps s1 to look like s2. Thus, path1 is the path that produces the smallest difference between s1(path1(t)) and s2(t). Likewise, s2(path2(t)) is close to s1(t). Using these paths, the above equation can be simplified so that the intermediate t is given by $$t^*=\text{lambda} * (\text{path2}(t1)-t1)+t1$$

For each point t along the s(lambda,t) line, the objective is to interpolate using the best possible t1 and t2. A value t* can be calculated for all values of t1 using the expression above. The value for t1 that produces t* closest to t can be used for the first half of the s-interpolation equation above.

To calculate the appropriate t2, the procedure is repeated from the other side. It is preferable to obtain the respective values for t1 and t2 by going in both directions, since the path is usually quantized. This value for t2 is used to calculate the second term in the s-interpolation equation above. This warping technique can be applied to any function of one variable, i.e. cepstral coefficients as a function of time, spectral slices as a function of frequency, or even warping gestures.

With reference to FIG. 4, during a morph energy moves along the dashed lines which connect corresponding temporal or frequency values of the two sounds. For instance, at a point which is 25% through the morph, the generated sound has a value equal to 75% of that for Sound 1 and 25% of the corresponding, matched value for Sound 2. As the morph progresses, successively greater proportions of the values for Sound 2 are employed.

Matching the features of the smooth spectrograms for the two sounds, at 32, is less critical than matching of the pitch spectrograms, at least where speech is concerned. In one approach, the two smooth spectrograms can simply be cross-faded, without prior warping. In an alternative approach, dynamic warping can be applied to the smooth spectra, as a function of frequency, to match peaks in the two sounds before warping and cross-fading them to obtain the morphed sound.

The warping, interpolation and cross-fading are carried out independently at 34 for each of the relevant components of the sounds. For example, at the 50% point of a morph, a formant frequency and a pitch that are halfway between those for each of the two original sounds can be employed. In such a case, the resulting sound will be in between the two sounds. Alternatively, it is possible to keep one of the components fixed, while varying another component. Thus, for example, the broad spectral shape for the morph might remain fixed with the first sound, while the pitch is changed to match the second sound. Various other combinations of modifications will be readily apparent.

The result of performing the cross-fades of the matched components of the two signals is a new set of representations for a sound having characteristics of each of the original input sounds. These representations are then combined to form a complete spectrogram. The spectrogram is then inverted at 36, to generate the new sound. The fast spectrogram techniques described in U.S. Pat. No. 5,473,759 can be used to efficiently perform this inversion.

Figure 5A:
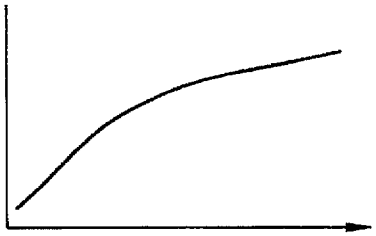
FIGS. 5A and 5B are illustrations of a continuous morph and a cyclostationary morph, respectively.
Figure 5B:
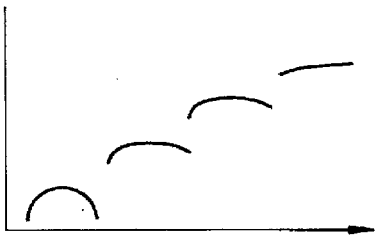
Figure 6:
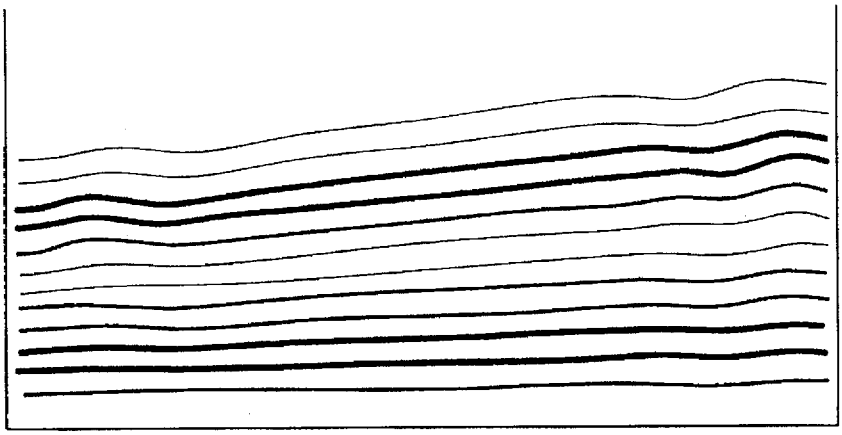
FIG. 6 is a spectrogram illustrating a morph in which the pitch of a spoken vowel changes.

As discussed previously, there are two different types of audio morphing that can be attained with the present invention. One type of morph is continuous, as depicted in FIG. 5A, and the other type of morph is cyclostationary, as depicted in FIG. 5B. A continuous morph is obtained in the case of simple sounds. For example, a note played on an oboe can smoothly transform over a given time span into a vowel spoken by a person. In another example, one vowel might morph into a different vowel, or the same vowel might morph from one pitch to another. A spectrogram for this latter example, which was produced in accordance with the present invention, is illustrated in FIG. 6.

Figure 7:
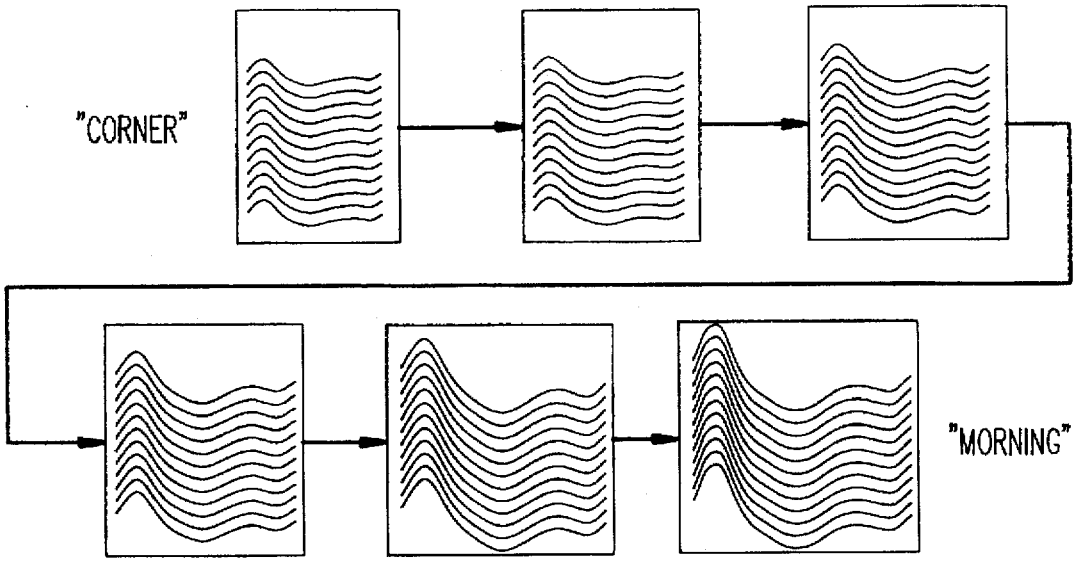
FIG. 7 is an illustration of a sequence of spectrograms in a cyclostationary morph.

In contrast to a continuous morph, a cyclostationary morph is comprised of multiple sound instantiations that form a sequence in which each sound differs from the others. For example, the word "corner" can transform into the word "morning" over a sequence of six steps. The spectrograms for such a sequence are illustrated in FIG. 7. Thus, the first spectrogram relates to the pronunciation of the word "corner" and the last spectrogram pertains to the word "morning." The four spectrograms between them represent various weighted interpolations of the two words.

From the foregoing, it can be seen that the present invention provides a morphing procedure in which any given sound can morph into any other sound. Since it is not based upon sinusoidal analysis, it is not limited in the types of sounds that can be utilized. Rather, a variety of different types of sound representations can be employed, in accordance with the perceptually significant features of the particular sounds that are chosen.

Furthermore, by utilizing dense or spectrographic representations of sounds, the morphing process can be completely automated. The different steps of the process, including the temporal and feature-based matching steps, can be implemented in a computer which is suitably programmed to convert an input sounds into appropriate representations, analyze the representations to match them to one another as described above, and then select a point between matched components to produce a new sound. As such, the labor-intensive requirements of previous audio morphing approaches can be avoided.

It will appreciated by those of ordinary skill in the art that the present invention can be embodied in other specific forms without departing from the spirit or essential characteristics thereof. The foregoing discussion of an embodiment of the invention was particularly directed to speech. However, the principles of the invention are equally applicable to other types of sounds as well, such as music. Depending upon the particular sounds to be morphed, different types of representations might be employed which provide a distance metric of the sound's features that are considered to be perceptually relevant.

Although the invention has been described with reference to its implementation in the morphing of two or more sounds, it will be appreciated that the principles of the invention are not limited to sound signals. Rather, they are applicable to any type of one-dimensional waveform. The presently disclosed embodiments are therefore considered in all respects to be illustrative and not restrictive. The scope of the invention is indicated by the appended claims, rather than the foregoing description, and all changes that come within the meaning and range of equivalence thereof are intended to be embraced therein.

What is claimed is:

1. A method for morphing from a first sound to a second sound, comprising the steps of:

analyzing each of said first and second sounds to obtain a dense representation for each sound;

determining correspondence between the respective representations of said sounds;

modifying the representations of said sounds, based on said correspondence, to form a new representation; and inverting the new representation and generating a morphed sound from the inverted representation.

2. The method of claim 1 wherein the dense representation is a time-frequency display.

3. The method of claim 2 wherein the time-frequency display is a spectrogram.

4. The method of claim 1 wherein the determination of correspondence includes the step of dynamically time warping the representations to match them to one another.

5. The method of claim 1 wherein said modification includes the step of interpolating between the representations of the two sounds.

6. The method of claim 5 wherein said modification includes the further step of warping the representations of the sounds.

7. The method of claim 1 wherein said representation includes information regarding the pitch of the sound, and the determination of correspondence includes the step of matching the pitch of the two sounds.

8. The method of claim 7 wherein the representation contains pitch information independent of whether the sound is voiced.

9. The method of claim 1 wherein said analyzing step includes the step of factoring each of said two sounds into a plurality of representations which respectively relate to different acoustic features of the sounds.

10. The method of claim 9 wherein one of said representations contains information regarding the pitch and voicing of the sound.

11. The method of claim 10 wherein another one of said representations contains information regarding the broad spectral characteristics of the sound.

12. The method of claim 1 further including the steps of generating another representation of each sound that provides a distance metric of the temporal correspondence between the two sounds, and temporally matching the two sounds to one another.

13. The method of claim 12 wherein said other representation comprises an MFCC analysis of each sound.

14. A method for morphing from a first sound to a second sound, comprising the steps of:

factoring each of said two sounds into a plurality of representations which respectively relate to different acoustic features of the sounds;

independently modifying said plural representations to produce a plurality of new representations;

combining said new representations to produce a representation for a morphed sound; and inverting the representation and generating the morphed sound from the inverted representation.

15. The method of claim 14 wherein one of said representations contains information regarding pitch and voicing aspects of the signal.

16. The method of claim 15 wherein said one representation comprises a pitch spectrogram.

17. The method of claim 15 wherein said one representation comprises a continuous estimate of pitch throughout the sound.

18. The method of claim 14 wherein one of said representations contains information regarding the broad spectral characteristics of the sound.

19. The method of claim 18 wherein said one representation comprises a spectrogram of the formant frequencies in a sound.

20. The method of claim 14 wherein said modifying step includes the step of interpolating corresponding values for a representation of each of the two sounds.

21. The method of claim 14 wherein said plural representations are independent of one another.

22. The method of claim 14 wherein said representations are dense.

23. The method of claim 14 further including the steps of generating a third representation of each sound that provides a distance metric of the temporal correspondence between the two sounds, and temporally matching the two sounds to one another.

24. A method for morphing from a first sound to a second sound, comprising the steps of:

analyzing each of said first and second sounds to obtain at least one representation of each sound;

automatically matching common regions of said representations so that they are temporally aligned with one another;

modifying predetermined portions of corresponding temporally aligned features of said first and second sounds; and inverting the modified sound representation and generating a sound having acoustic characteristics between those of said first and second sounds.

25. The method of claim 24 wherein said temporal matching comprises the step of obtaining MFCC representations of the sounds, and matching corresponding portions of the MFCC representations.

26. The method of claim 24 further including the step of determining correspondence between at least one acoustic feature in the representation of said first and second sounds.

27. The method of claim 26 wherein the matching of corresponding portions is carried out through dynamic time warping techniques.

28. The method of claim 24 wherein the representation comprises a dense spectral analysis of each sound.

29. The method of claim 28 wherein said dense spectral analysis comprises a pitch spectrogram which provides a distance metric for pitch information in a sound.

30. The method of claim 28 wherein said dense spectral analysis comprises a smooth spectrogram which provides a distance metric for formant frequencies in a sound.

31. The method of claim 24 wherein said analyzing step comprises factoring each of said two sounds into a plurality of representations which respectively relate to different acoustic features of the sounds.

32. The method of claim 31 wherein said plurality of representations include a pitch spectrogram and a smooth spectrogram for each sound.

33. The method of claim 31 wherein each of said plurality of representations is separately warped and interpolated, and then combined to form said modified sound representation.

34. The method of claim 24 wherein said modification comprises warping and interpolating the representations of the sounds to form said modified sound representation.

35. A method for generating a sound based upon a dense spectral representation of a sound, comprising the steps of:

generating a first spectrogram of a sound;

determining the mel-frequency cepstral coefficients for the sound from said first spectrogram;

inverting the mel-frequency cepstral coefficients to obtain a spectrogram of the formants of the sound; and subsequently generating a sound which is based upon information contained in the formant spectrogram.

36. The method of claim 35 further including the step of dividing said first spectrogram by said formant spectrogram to obtain a pitch or residual spectrogram, and generating said sound on the basis of information contained in the pitch spectrogram.

37. A method for producing a morph comprising a transition from one spoken word to another spoken word, comprising the steps of:

generating a dense spectral representation of each spoken word;

generating a plurality of modified representations, each of which comprises a different respective interpolation of corresponding values in the representation of said two sounds; and sequentially inverting each of said modified representation and generating a series of discrete sounds which transition from one of said spoken words to the other of said spoken words, and which include characteristics of each of said spoken words.

38. A method for transforming from a one-dimensional signal representing a physical phenomenon to a second one-dimensional signal representing another physical phenomenon, comprising the steps of:

automatically defining points of correspondence between the respective signals;

determining a desired point in a morphed signal, and selecting a pair of corresponding points in the original signals that are related to the determined point; and warping and interpolating the original signals, based on said pair of corresponding points, to form a morphed signal, and generating a sensory perceptible physical phenomenon corresponding to said morphed signal.

39. The method of claim 38 wherein said defining step includes the use of dynamic time warping to match the two original signals.

40. The method of claim 38 further including the step of cross-fading the warped and interpolated signals.

41. The method of claim 38 wherein each of said original signals is comprised of multiple waveforms, and wherein plural waveforms of each original signal are separately warped and interpolated.

42. The method of claim 41 further including the step of combining the separately warped and interpolated waveforms to form the morphed signal.

43. The method of claim 38 wherein said points constitute a dense correspondence between the signals.

44. The method of claim 38 wherein said morphed signal is defined at a dense set of points.

45. The method of claim 38 wherein said physical phenomena are audible sounds.

46. A method for generating an output sound which includes characteristic features of each of two input sounds, comprising the steps of:

factoring each of said two input sounds into representations which include at least a pitch spectrogram for a first one of said two input sounds and at least a formant spectrogram for a second one of said two input sounds;

combining information obtained from said pitch spectrogram for said first input sound with information obtained from said formant spectrogram for said second input sound to form a new representation for a morphed sound; and inverting said new representation and generating an output sound.

47. A method for generating a morphed sound from first and second input sounds, comprising the steps of:

factoring each of said two input sounds into a plurality of representations which respectively relate to different acoustic features of the sounds;

combining information obtained from a representation of the first input sound which relates to a first acoustic feature with information obtained from a representation of the second input sound that relates to a second, different acoustic feature, to produce a representation for a morphed sound; and inverting the representation for the morphed sound and generating the morphed sound from the inverted representation.

* * * * *